US008884176B2

(12) United States Patent
Juhlin

(10) Patent No.: US 8,884,176 B2
(45) Date of Patent: Nov. 11, 2014

(54) HVDC BREAKER AND CONTROL APPARATUS FOR CONTROLLING AN HVDC BREAKER

(75) Inventor: Lars-Erik Juhlin, Ludvika (SE)

(73) Assignee: ABB Technology AG, Zurich (CH)

( * ) Notice: Subject to any disclaimer, the term of this patent is extended or adjusted under 35 U.S.C. 154(b) by 272 days.

(21) Appl. No.: 13/504,411

(22) PCT Filed: Oct. 27, 2009

(86) PCT No.: PCT/EP2009/064113

§ 371 (c)(1),
(2), (4) Date: May 22, 2012

(87) PCT Pub. No.: WO2011/050832

PCT Pub. Date: May 5, 2011

(65) Prior Publication Data

US 2012/0234796 A1 Sep. 20, 2012

(51) Int. Cl.

| | |
|---|---|
| ***H01H 33/02*** | (2006.01) |
| ***H01H 33/59*** | (2006.01) |
| *H01H 9/16* | (2006.01) |
| *H01H 9/00* | (2006.01) |
| *H01H 33/16* | (2006.01) |

(52) U.S. Cl.

CPC ..... *H01H 33/596* (2013.01); *H01H 9/167* (2013.01); *H01H 2009/0083* (2013.01); *H01H 33/161* (2013.01)

USPC ..... 218/143

(58) Field of Classification Search

CPC ... H01H 33/596; H01H 33/14; H01H 33/161; H01H 71/00; H01H 9/54

USPC ..... 218/143

See application file for complete search history.

(56) References Cited

U.S. PATENT DOCUMENTS

| | | | | |
|---|---|---|---|---|
| 2,938,387 | A * | 5/1960 | Hamilton | 73/755 |
| 3,275,892 | A * | 9/1966 | Schweitzer, Jr. | 361/102 |
| 3,351,814 | A * | 11/1967 | Riebs | 361/98 |
| 4,614,843 | A * | 9/1986 | Coulmance | 379/352 |
| 2003/0193770 | A1 | 10/2003 | Chung | |
| 2012/0032762 | A1* | 2/2012 | Lescale | 335/11 |
| 2013/0293985 | A1* | 11/2013 | Lescale | 361/8 |
| 2014/0055903 | A1* | 2/2014 | Juhlin | 361/115 |

FOREIGN PATENT DOCUMENTS

| | | |
|---|---|---|
| EA | 0 749 140 A1 | 12/1996 |
| EP | 0 108 279 A1 | 5/1984 |

* cited by examiner

*Primary Examiner* — Truc Nguyen

(74) *Attorney, Agent, or Firm* — Birch, Stewart, Kolasch & Birch, LLP

(57) ABSTRACT

The invention relates to an HVDC breaker (300) comprising at least two individually controllable HVDC breaker sections (305) connected in series, wherein the HVDC breaker is arranged in a manner so that the number of HVDC breaker sections tripped upon tripping of the HVDC breaker depends on the operational event in response to which the tripping occurs. The invention further relates to a control apparatus (400) for controlling the HVDC breaker, as well as to a method of breaking an HVDC line. The method comprises receiving (500) a system status signal indicative of an operational event requiring the breaking of the HVDC line, and determining (505) the number of HVDC breaker sections required for the breaking.

20 Claims, 11 Drawing Sheets

100/305

700a
705a
420a
V
700b
705b
420b
700c
705c
420c
705d
420d
700d
715i
-V
710i
U
to 305i
435i
720ii
t
+V
τ
715ii
710ii
to 305ii
435ii
720iii
715iii
710iii
to 305iii
435iii
720iv
715iv
710iv
to 305iv
435iv
720v
715v
710v
to 305v
435v
445i
445ii
445iii
445iv
700e
405

HVDC BREAKER AND CONTROL APPARATUS FOR CONTROLLING AN HVDC BREAKER

TECHNICAL FIELD

The present invention relates to the field of high voltage direct current power transmission, and in particular to high voltage direct current breakers.

BACKGROUND

A High Voltage Direct Current (HVDC) breaker is a switching device capable of making, breaking and continuously carrying a DC current at a high voltage. An HVDC breaker is often used as a component in an HVDC system for power transmission.

Since there are no natural zero-crossings of the current or voltage in a direct current system, special attention has to be given to HVDC circuit breaker design. The power transmitted via an HVDC system is typically very high, and can for example be in the order of GW. When breaking the current in an HVDC system with a mechanical interrupter in the HVDC breaker, an arc is built up between the interrupter contacts, which can only be extinguished by forcing a current zero. As the arc has a negative resistance, a resonant circuit has been introduced in order to create artificial current zeros in mechanical HVDC breakers. Furthermore, a non-linear resistor is typically connected in parallel with the resonant circuit. Once the arc current has been forced to zero, the current is commutated to the non-linear resistor, which absorbs the energy of the interruption process and limits the voltage. Known further techniques for facilitating the extinguishing of the arc are the use of an inert gas, such as SF6, or the placement of the interrupter contacts in a vacuum vessel. As an alternative to mechanical HVDC breakers, solid state HVDC breakers are proposed in the art which make use of a power semiconductor switch as interrupter.

SUMMARY

A problem to which the present invention relates is how to obtain an HVDC voltage breaker that could efficiently be used for breaking an HVDC current during normal operation as well as in a line fault situation.

The invention relates to an HVDC breaker comprising at least two HVDC breaker sections connected in series, wherein at least one of the HVDC breaker sections or at least one group of the HVDC breaker sections is arranged to be controlled individually from the other HVDC breaker sections. The HVDC breaker is arranged in a manner so that the number of HVDC breaker sections tripped upon tripping of the HVDC breaker depends on the operational event in response to which the tripping occurs.

By tripping the HVDC breaker it is meant that the state of the HVDC breaker is changed from a closed to an open state while current is flowing through the HVDC breaker, where according to the invention not always all series connected sections of the HVDC breaker are operated but only a certain number of them. In order to be able to trip—or operate—only a certain number of the HVDC breaker sections, the sections are arranged to be controlled individually either in groups or even one by one or a mixture thereof. The number of HVDC breaker sections which is tripped depends on the operational event in response to which the tripping occurs. This has the advantage that the breaking capability of the HVDC breaker can be adapted to the demands of the present operational event. A suitable balance between fast breaking operation and disturbances in the system caused by the breaking operation can be found for each operational event individually.

In one aspect, an HVDC breaker section comprises at least one mechanical interrupter and/or at least one power semiconductor interrupter.

In another aspect, at least one HVDC breaker section comprises a section status indicating device arranged to detect if the operation of an HVDC breaker section has been unsuccessful. The section status indicating device is further arranged to generate a section status signal indicative of unsuccessful operation in case an HVDC breaker section has not operated successfully. Hereby, it is achieved that an unsuccessful operation of an HVDC breaker section can be quickly detected, and a major impact of such fault upon the breaking procedure can often be avoided.

In yet another aspect, the HVDC breaker comprises at least one redundant HVDC breaker section, i.e. at least one HVDC breaker section more than actually needed for the full operation of the HVDC breaker. Hereby is achieved that an efficient breaking operation may be ensured even in the event of one or more faulty HVDC breaker sections.

The invention further relates to a control apparatus for controlling the tripping of an HVDC breaker. The control apparatus comprises: a system status signal interface arranged to receive system status signals of at least two different types, wherein the system status signal type is indicative of an operational event in an HVDC system of which the HVDC breaker forms a part; a section actuating signal interface arranged to transmit, to the HVDC breaker, a section actuating signal causing at least one individually controllable HVDC breaker section and/or group of HVDC breaker sections of the HVDC breaker to trip; and an actuating control mechanism connected to the system status signal interface and to the section actuating signal interface. The actuating control mechanism is arranged to determine, based on information relating to the type of at least one received system status signal, the number of HVDC breaker sections and/or groups of HVDC breaker sections that should be tripped, and to send, via the section actuating signal interface, a corresponding section actuating signal or signals to trip said number of HVDC breaker sections and/or groups of HVDC breaker sections.

In one aspect, the actuating control mechanism of the control apparatus is further arranged to select which of the HVDC breaker sections and/or groups of HVDC breaker sections are to be tripped in response to the receipt of the system status signal and to send, via the section actuating signal interface, the corresponding section actuating signal or signals to trip the selected HVDC breaker sections and/or groups of HVDC breaker sections.

In another aspect, the control apparatus further comprises: an interface arranged to receive, from a section status indicating device, a section status signal indicative of unsuccessful operation of an HVDC breaker section. In this aspect, the actuating control mechanism is arranged to send, in response to receipt of a section status signal indicative of unsuccessful operation of an HVDC breaker section, a section actuating signal to trip a currently closed HVDC breaker section or group of HVDC breaker sections.

The invention also relates to an HVDC breaker system including a control apparatus and an HVDC breaker according to the embodiments described above, as well as to an HVDC power transmission system comprising such HVDC breaker system.

The invention further relates to a method of interrupting a DC current in an HVDC system, the method comprising:

receiving, in a control apparatus for controlling an HVDC breaker having at least two HVDC breaker sections, a system status signal the type of which is indicative of an operational event requiring the interruption of the DC current; determining, in dependence on the type of the system status signal received, the number of HVDC breaker sections and/or groups of HVDC breaker sections to be used for interruption of the DC current; and sending, to the HVDC breaker, a corresponding section actuating signal or signals to trip said number of HVDC breaker sections and/or groups of HVDC breaker sections.

DETAILED DESCRIPTION

Figure 1:
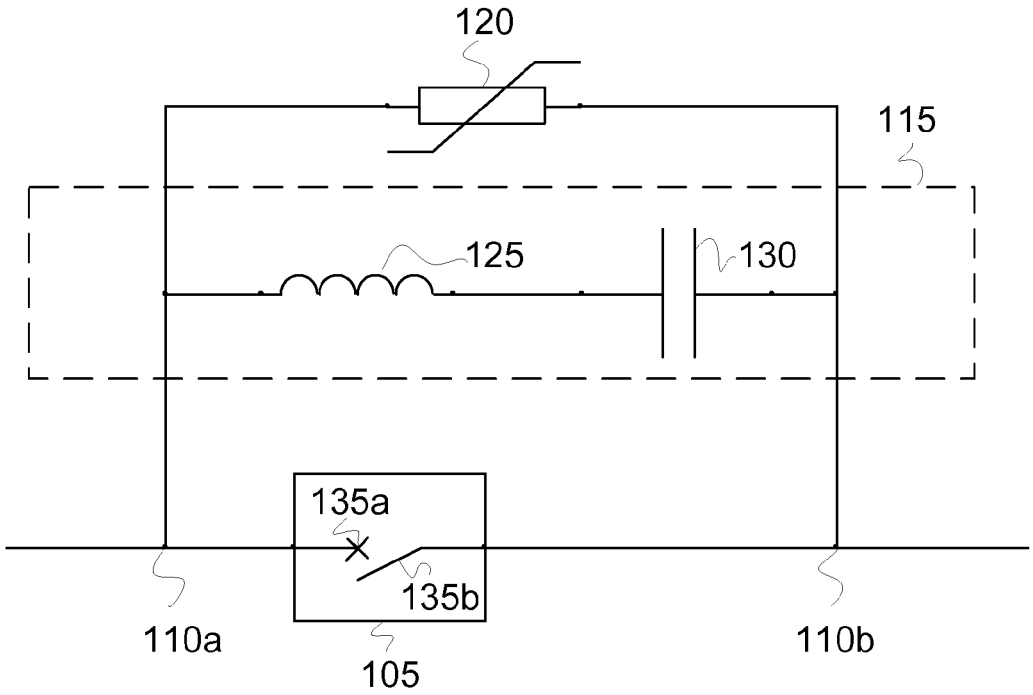
FIG. 1 shows an example of an HVDC breaker.

An example of an HVDC circuit breaker 100 is schematically illustrated in FIG. 1. The HVDC circuit breaker 100 of FIG. 1 comprises a mechanical interrupter 105 connected between two connection points 110*a* and 110*b*. A resonant circuit 115 is connected in parallel to the interrupter 105. A non-linear voltage dependent resistor 120 is also connected in parallel to the interrupter 105. The resistance of the non-linear resistor 120 decreases with increasing voltage. The resonant circuit 115 comprises a capacitance 130, as well as an inductance 125.

When a current-carrying circuit which comprises the HVDC circuit breaker 100 of FIG. 1 is interrupted by opening of interrupter 105, an arc is built up between the interrupter contacts 135*a* and 135*b*. The arc has the characteristic of a negative resistance—the arc voltage decreases with increasing current. An arc voltage is therefore not entirely constant, and consequently, a current/voltage oscillation is built up by means of the resonant circuit 115. If the resonant circuit is suitably dimensioned, a current zero crossing will occur, at which the arc will be extinguished. The current will then be commutated to the capacitance 130, which will be charged, and a voltage will be built up across the capacitance 130 and the non-linear resistance 120. As the voltage across the non-linear resistance 120 increases, the current will be commutated to the non-linear resistance 120. The commutation process from interrupter 105 to non-linear resistor 120 is fairly fast. The DC current through the breaker 100 will therefore typically be nearly constant during the commutation process due to the total inductance of the circuit.

Figure 2:
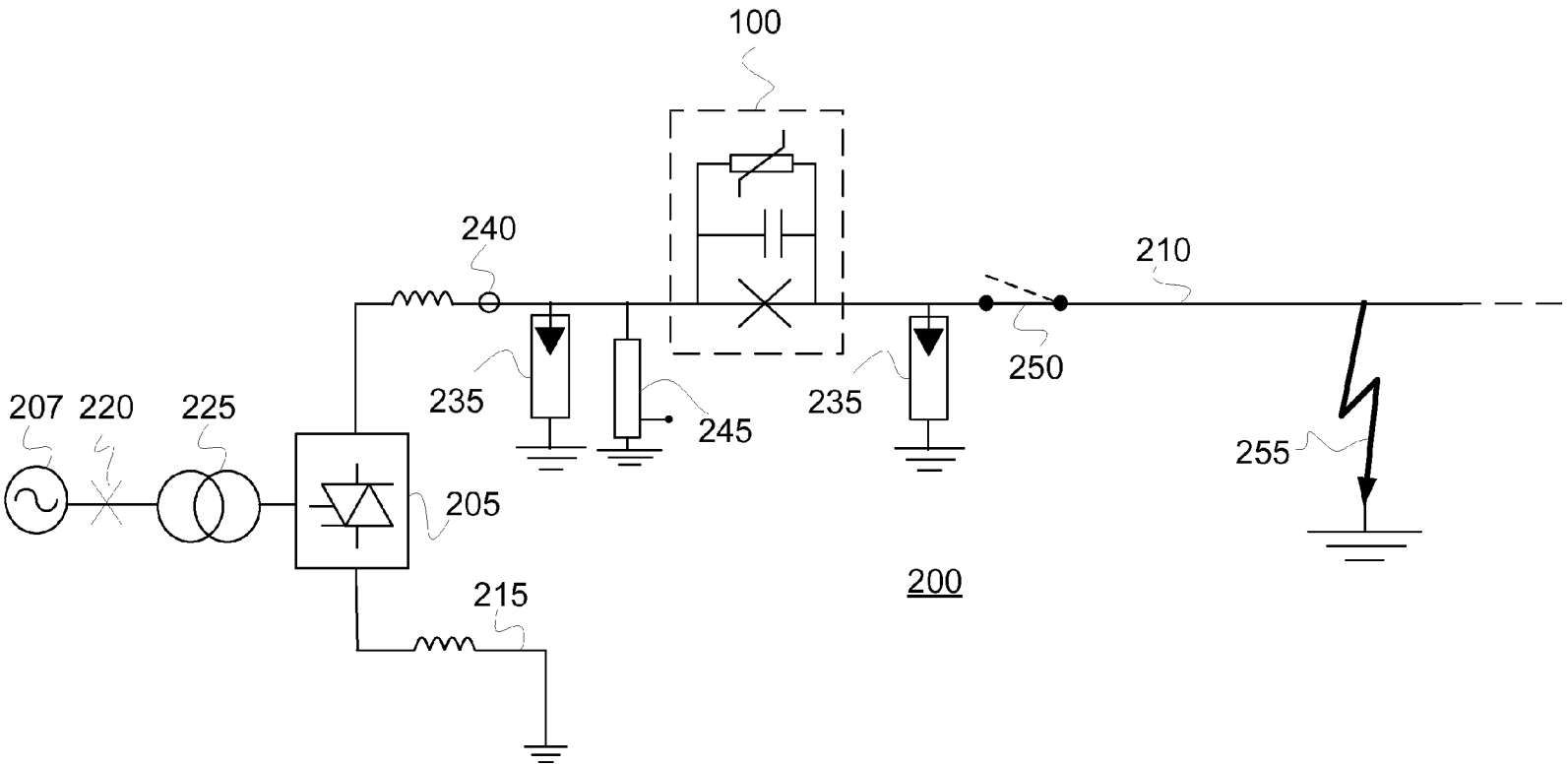
FIG. 2 shows an example of an HVDC system for power transmission including an HVDC breaker.

An example of a HVDC system 200 wherein two HVDC converters 205 are connected by means of an HVDC line 210 is schematically illustrated in FIG. 2, wherein only half of the system 200, comprising one of the HVDC converters 205, is shown. The HVDC line 210 of FIG. 2 is connected to an HVDC breaker 100 by means of which the HVDC line 210 may be disconnected. The other end of the HVDC line 210 (not shown) of HVDC system 200 of FIG. 2 is connected to a similar converter 205 via another HVDC breaker 100. In FIG. 2, an earth fault on the HVDC line 210 has been indicated by an arrow 255.

The HVDC converter 205 which is shown in FIG. 2 is connected to an AC power source 207. For illustrative purposes, the HVDC system 200 of FIG. 2 is shown to be a monopolar HVDC system, where grounded electrode lines 215 are used for the return current. However, the present invention is applicable to all types of HVDC systems 200 including bipolar systems.

Equipment of HVDC system 200 being located on the AC side of HVDC converter 205 is said to form part of the AC side of the HVDC system 200, whereas equipment located between the HVDC converters 205 is said to form part of the DC side of the HVDC system 200. An AC circuit breaker 220 is shown on the AC side of HVDC system 200, as well as a transformer 225. On the DC side, an arrester 235 is included on both sides of the breaker 100 in order to protect the HVDC system 200 from overvoltages. Furthermore, current measurement equipment 240 is included on the DC side in order to facilitate for measurement of the current in the HVDC line 210, as well as voltage measurement equipment 245 for measuring the voltage at a position in the HVDC system 200. Current measurement equipment 240 could for be a DC current transducer of any type. Voltage measurement equipment 245 of FIG. 2 is located between the converter 205 and the breaker 100. Further or alternative monitoring equipment and protection devices could also be included in system 200. As shown in FIG. 2, a disconnector 250 can be connected in series with the breaker 100 to fully isolate the converter 205, if desired, after tripping of the HVDC breaker 100 in a situation where the HVDC line 210 has to be disconnected. An HVDC system 200 typically includes further equipment which has been left out of FIG. 2 for sake of clarity.

An HVDC breaker 100 is typically dimensioned for breaking of a particular current at a particular voltage. For example, the non-linear resistance 120 can be designed so that its resistance drops at a particular voltage, this voltage value for example being selected in such a way that the voltage drop at the rated surge current of the breaker 100 will be in accordance with the rated voltage of the breaker 100; the capacitance 130 can be chosen so that the current oscillations upon opening of the interrupter 105 will be sufficiently large to extinguish the arc current, etc. The voltage across the non-linear resistance 120 at rated surge current is often referred to as the Switching Impulse Protection Level (SIPL).

When an HVDC breaker 100 is used for interrupting a DC current in a short circuit or earth fault situation, hereinafter referred to as a line fault situation, the breaking time is often a critical factor for limiting the disturbance of power transmission in the un-faulty part of the system. The stresses of the system and the risk of damage caused by a short circuit current typically increases the longer time the short circuit current is allowed to flow in the system.

However, the interruption of a DC current in an HVDC system 200 by means of an HVDC breaker 100 may be desired under a number of different circumstances. As discussed above, in case of a line fault on the HVDC line 210, the breaking of the HVDC line 210 may be very urgent in order to limit the disturbances and damages caused by short-circuit currents. It may also sometimes be desired to disconnect the HVDC line 210 under normal operation. For example, an HVDC breaker 100 could be used for disconnection of an HVDC converter 205 from the HVDC line 210; for disconnection of an HVDC line 210 from a multi-station HVDC system 200; etc. However, the requirements on an HVDC breaker 100 for breaking an HVDC line 210 during normal operation are typically different to those on an HVDC breaker 100 for breaking a faulty line. In a line fault situation such as a short circuit or earth fault, the voltage required over the breaker 100 generally exceeds the rated voltage. When breaking the HVDC line 210 during normal operation, on the other hand, the required voltage is considerably smaller, typically in the order of 20-40% of the rated voltage. If a breaker 100 designed to set up a considerably higher counter voltage is used for breaking of the HVDC line during normal operation, voltage transients will occur, which will stress and disturb other parts of the system 200.

During normal operation, it is typically of importance that the breaking of the HVDC line 210 does not disturb the operation of the HVDC system 200 in an unacceptable manner, whereas time might not be such a critical factor—if the breaking of the current takes time, no harm is done. In a short-circuit or earth fault situation, on the other hand, breaking of the current is urgent, and a fast breaking of the current generally has a higher priority than keeping the disturbances in other parts of HVDC system 200 at a low level. Furthermore, the voltage stress will be less as the voltage on one side of the HVDC breaker 100 is nil. At breaking of normal load, the voltage on both sides of the HVDC breaker 100 amounts to the rated voltage, on top of which the transients of from the HVDC breaker 100 will be added.

The absolute value of the time derivative of the current through the non-linear resistor 120 increases with increasing voltage over the non-linear resistor 120. Hence, the properties of the non-linear resistor 120 effects the current breaking time of HVDC breaker 100. The higher the voltage over the non-linear resistance 120, the higher will be the rate of decrease of the current. A large value of the SIPL of the non-linear resistor 120 is thus desired in a line fault situation. However, with a larger SIPL, larger transients will occur, which will stress the arresters 235, etc of a system 200. Hence, in an HVDC breaker 100 for breaking an HVDC line 210 during normal operation, a smaller value of the SIPL of the non-linear resistor 120 would typically be desired than in a line fault situation. With a non-linear resistor 120 having a smaller SIPL, the transients will be smaller, at the expense of breaking operation speed.

Figure 3:
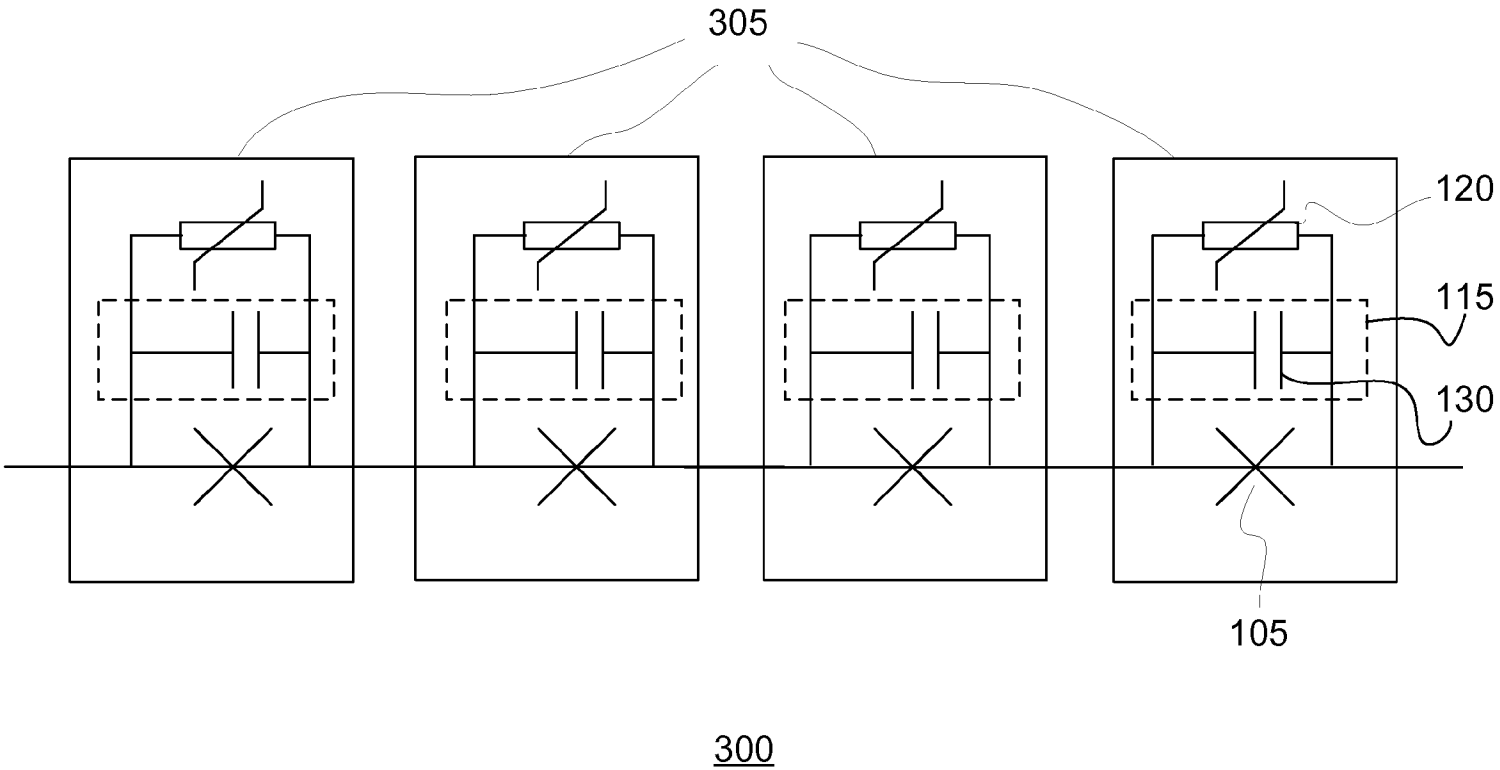
FIG. 3 shows an example of a sectionalized HVDC breaker design wherein the HVDC breaker comprises four HVDC breaker sections.

By connecting a set of HVDC breaker sections in series, the HVDC breaker sections and/or pre-selected groups of the HVDC breaker sections being individually controllable, an HVDC breaker which is suitable for breaking an HVDC line 210 both in a line fault situation and during normal operation can be achieved. An HVDC breaker 300 comprising a set of HVDC breaker sections 305 is schematically illustrated in FIG. 3. Such HVDC breaker 300 can be referred to as a sectionalized HVDC breaker 300. The HVDC breaker 300 of FIG. 3 comprises four HVDC breaker sections 305, each HVDC breaker section 305 comprising an interrupter 105; a resonant circuit 115 having a capacitor 130; and a non-linear resistor 120. A set of HVDC breaker sections 305 could include any number of individually controllable HVDC breaker sections and/or groups of HVDC breaker sections exceeding one. In the example of FIG. 3, all four HVDC breaker sections 305 could each be controllable individually. In the alternative, the two HVDC breaker sections 305 to the left of the figure could form a first controllable group and the remaining two HVDC breaker sections 305 to the right of the figure could from a second controllable group, where the HVDC breaker sections of each group are arranged to be operated simultaneously. Any other combination is possible, for example the HVDC breaker sections 305 furthest to the left and right could be controllable separately and the two HVDC breaker sections 305 in the middle could form a controllable group. The interrupter 105 of an HVDC breaker section 300 typically has a mechanical arrangement to actuate the separation of the contacts 135 of the interrupter 105. An interrupter 105 could for example be a puffer breaker, also referred to as a piston breaker; a self-blast breaker, or any other suitable breaker. Variants of the interrupter 105 may include SF6 or vacuum breakers. The interrupter 105 may in an alternative be a power semiconductor interrupter or switch, either standing alone or being combined with other mechanical and/or power semiconductor interrupters. An actuator of the mechanical interrupter 105 could for example be a spring operated mechanism, a pneumatic operation mechanism, a hydraulic operating mechanism, a hydraulic spring-operated mechanism, or any other suitable mechanism. In order to allow for separate control of the HVDC breaker sections 305 of an HVDC breaker 300, the actuating mechanisms of the different HVDC breaker sections 305 should preferably be physically separated and individually controllable. An HVDC breaker section 305 could for example be arranged to receive a section actuating signal which will cause its interrupter 105 to trip. Such section actuating signal could be received directly from an external control apparatus, or via a device in HVDC breaker 300 arranged to receive one or more section actuating signals and to distribute such signal or signals to the relevant HVDC breaker section or sections 305. Such a device could for example be a processor or other logical circuit.

In an HVDC breaker 300 comprising a set of HVDC breaker sections 305 which are connected in series, the non-linear resistors 120 of the HVDC breaker sections 305 which are tripped in response to an operational event will act together to absorb the energy of the interruption process. Hence, the voltage over each non-linear resistor 120 will be less than if an HVDC breaker 100 having only one HVDC breaker section were to be used. Thus, non-linear resistors 120 having a lower SIPL value could be used. As a consequence, the maximum voltage experienced by capacitance 130 will be lower, and the physical size of a capacitor providing the capacitance 130 can be reduced.

By providing a set of series-connected HVDC breaker sections 305 in an HVDC breaker 300, where the sections are individually controllable either one by one or in groups or in a mixture thereof, the breaking capacity of the HVDC breaker 300 can be adapted to the demands of a particular operational event. For example, an HVDC breaker 300 could be designed so that when all HVDC breaker sections 305 of the set are tripped at the same time, the HVDC breaking capability of the HVDC breaker 300 corresponds to the requirements of a line fault situation. Hence, in the operational event of a line fault situation, all the HVDC breaker sections 305 of such an HVDC breaker 300 would be tripped. On the other hand, in the operational event of disconnecting an HVDC converter 205 or an HVDC line 210 during normal operation, for maintenance purposes for example, it may be sufficient to trip only one or some of the HVDC breaker sections 305 of such HVDC breaker 300, since the time requirement is not as strict. Any voltage transients arising from the line breaking action will hence be smaller than if a large HVDC breaker 100, designed to break the HVDC line 200 in a line fault situation, was to be tripped.

Hence, an HVDC breaker 300 comprising a set of series-connected, individually controllable HVDC breaker sections 305 or groups of HVDC breaker sections can be adjusted to the present demands, and provide on-demand current breaking properties.

The number of HVDC breaker sections 305 to be tripped in response to a particular operational event could depend on the type of event. Examples of operational events which could require the tripping of one or more HVDC breaker sections 305 or groups of HVDC breaker sections 305 of HVDC breaker 300 are: a scheduled disconnection of an HVDC converter 205; an earth fault on the HVDC line 210 connected via the HVDC breaker 300; the loss of auxiliary power to an HVDC converter 205, etc. A suitable number of HVDC sections 305 and/or groups of HVDC sections 305 to be tripped could be set for a particular event so that a suitable balance between a fast breaking operation and small transients is obtained.

Figure 4:
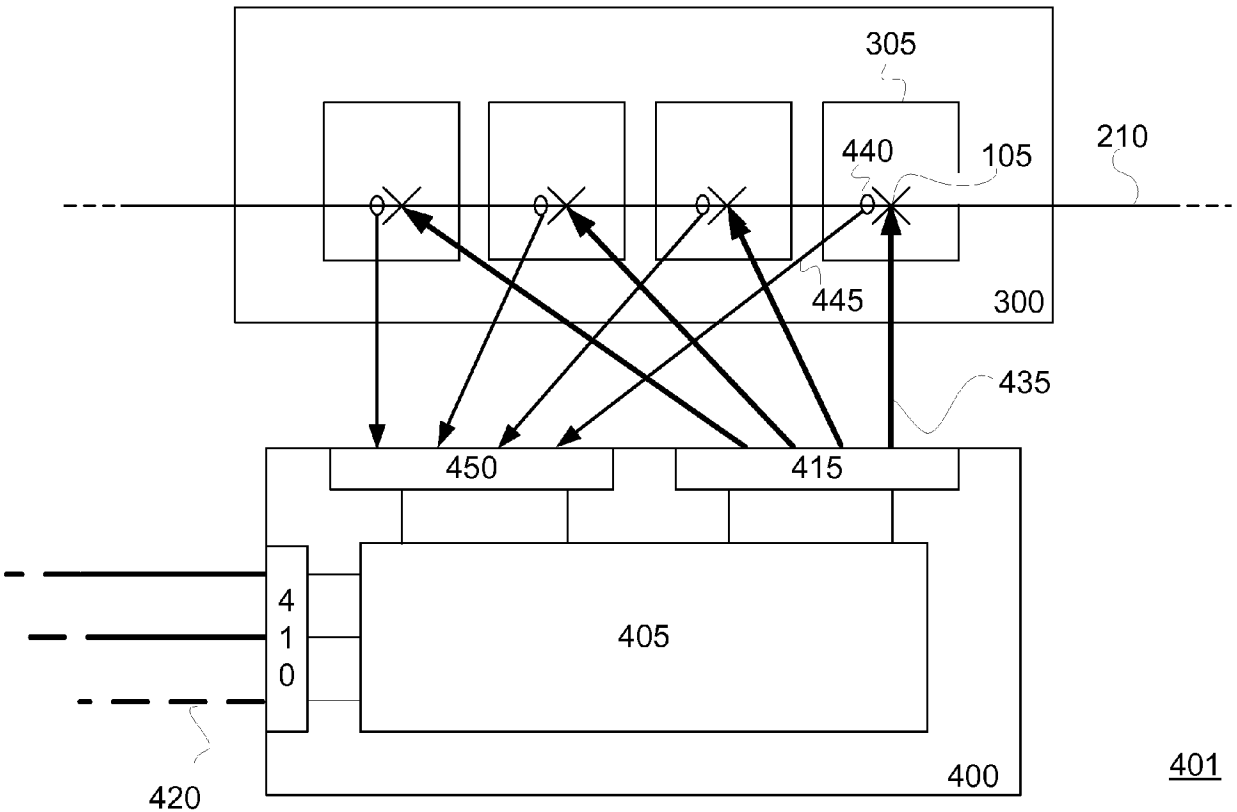
FIG. 4 shows an example of an HVDC breaker system comprising a control apparatus connected to a sectionalized HVDC breaker, the control apparatus being arranged to control the tripping of the sectionalized HVDC breaker.

An example of an HVDC breaker system 401 comprising an HVDC breaker 300 and a control apparatus 400 for individually controlling the tripping action of the HVDC breaker sections 305 of an HVDC breaker 300 is schematically illustrated in FIG. 4. In the example of FIG. 4, the control apparatus 400 is shown to control the tripping action of an HVDC breaker 300 including four HVDC breaker sections 305, wherein, in order to improve clarity of the drawing, reference numerals have only been indicated for one of them. However, a control apparatus 400 could be designed to control an HVDC breaker 300 comprising any number of HVDC breaker sections 305. Although shown in FIG. 4 to be two separate physical entities, the breaker 300 and the control apparatus 400 could be incorporated into the same physical device, if desired.

The control apparatus 400 of FIG. 4 comprises an actuating control mechanism 405, a system status signal interface 410 and a section actuating signal interface 415, wherein the actuating control mechanism 405 is connected to the system status signal interface 410 and the section actuating signal interface 415.

The system status signal interface 410 is arranged to receive system status signals 420. A system status signal 420 could for example be a signal generated by a protection device arranged to detect a particular fault occurring in a particular part of the HVDC system 200. Examples of protection devices which could generate a system status signal 420 are the current measurement equipment 240 and the voltage measurement equipment 245 of FIG. 2, which are arranged to sense DC line faults on HVDC line 210. Differential protection devices could be used, which can be arranged to compare the current at two ends of an HVDC line 210, or to determine the sum of the currents flowing into a DC bus in an HVDC system 200 including more than two HVDC converters 205. Protection devices could be located at suitable locations in system 200 in order to detect for example earth faults, line faults, switching faults, over currents, internal faults in an HVDC converter 205, etc. Protection devices are generally well known in the art, and will not be further discussed herein.

An operations and maintenance (O & M) system could also be arranged to generate a system status signal 420 which is received by the system status signal interface 410, if desired, for example in case of a scheduled breaking operation of the HVDC line 210. A system status signal 420 could also be manually entered into system status signal interface 410 by means of a user interface.

Any system status signals 420 received by the system status signal interface 410 will be relayed to the actuating control mechanism 405. The actuating control mechanism is arranged to receive at least two types of system status signals 420. System status signals 420 to which the actuating control mechanism 405 is arranged to respond to in the same manner will be referred to as being of the same system status signal type. Different system status signals 420 of the same type may come from different system status signal sources. Based on the type or types of the received system status signal or signals 420, the actuating control mechanism 405 will determine the number of HVDC breaker sections 305 and/or groups of HVDC breaker sections 305 to trip. Furthermore, the actuating control mechanism 405 will send, via section actuating signal interface 415 to the HVDC breaker 300, at least one section actuating signal 435 indicative of the number of HVDC breaker sections 305 and/or groups of HVDC breaker sections 305 which should be tripped. In one implementation, such section actuating signal 435 is sent as an individual section actuating signal 435 to each of the interrupters 105 of the HVDC breaker sections 305 that should be tripped (cf. FIG. 4), such section actuating signals 435 being for example in the form of pulses. In another implementation, such section actuating signal 435 could be sent as a single signal indicative of the number of HVDC breaker sections and/or groups of HVDC breaker sections that should be tripped. Depending on the design of the HVDC breaker 300, the section actuating signals 435 sent by the control apparatus 400 could for example be an electrical pulse signal, an optical pulse signal, an electrical data signal, an optical data signal, a radio signal etc.

In FIG. 4, each HVDC breaker section 305 is shown to further include an optional section status indicating device 440 arranged at each interrupter 105 in order to detect whether the tripping of a particular HVDC breaker section 305 has been successful. A section status indicating device 440 could for example be an auxiliary contact for indicating whether the interrupter 105 has opened mechanically; a DC current measurement device connected to measure any arc current between opened contacts 135*a* and 135*b* of the interrupter 105; a combination of the two; or any other suitable device capable of detecting whether the interrupter 105 has opened correctly and/or whether the commutation of the current from the interrupter 105 to the capacitor 130 has successfully occurred. A section status signal 445, indicative of whether or not the interrupter 105 of an HVDC breaker section 305 has operated correctly, could then be sent from the section status indicating device 440 to the control apparatus 400. The control apparatus 400 of FIG. 4 comprises a section status signal interface 450 arranged to receive such section status signals 445. The section status signal interface 450 is arranged to relay any received section status signals 445 to the actuating control mechanism 405. The actuating control mechanism 405 could advantageously be arranged to send, in response to the receipt of a section status signal 445 indicating that the actuation of an HVDC breaker section 305 has been unsuccessful, a section actuating signal 435 to an HVDC breaker section 305 which has not yet been opened, such as for example a redundant HVDC breaker section 305. By providing a section status indicating device 440 at an interrupter 105, the time to detect a faulty operation of the interrupter 105 can significantly be reduced: the time could typically fall within a time scale of the order of 1-10 ms, which is a significant reduction compared to the situation where the faulty operation is detected only after having discovered that the HVDC breaker 300 has not been successful in forcing the current through the HVDC breaker 300 to zero. An HVDC breaker 300 could be designed so that none, some, or all of the HVDC breaker sections 305 and/or of the groups of HVDC breaker sections 305 include a section status indicating device 440.

The section status signal 445 could be seen as a type of system status signal 420, and the section status signal interface 450 could be seen as part of the system status signal interface 410. The same, or different, physical interfaces could be used for implementation of the system status signal interface 410 and the section status signal interface 450. Furthermore, the interfaces 410 and 415 could be the same, or different, physical interfaces.

An actuating control mechanism could preferably be designed so that if system status signals of different types are received at the same time, the signal of the type requiring the opening of the highest number of HVDC breaker sections 305 will prevail. In this way, it can be ensured that the required number of HVDC breaker sections 305 will always be instructed to open.

An HVDC breaker 300 could be designed to include one or more redundant HVDC breaker sections 305, so that the tripping of less than all HVDC breaker sections 305 would be required also in the worst case line fault scenario. This can be achieved by ensuring that the sum of the SIPL-values of the non-linear resistors 130 of less than all HVDC breaker sections 305 exceeds the rated line voltage of the HVDC breaker 300, so that the counter voltage generated across the HVDC breaker 300 upon tripping of less than all HVDC breaker sections 305 will exceed the rated voltage with sufficient margin to interrupt the current. Thus, in case a faulty operation of an HVDC breaker section 305 is discovered by the actuating control mechanism 405, for example by receipt of a section status indicating signal 445, there will be another HVDC breaker section 305 to trip also in the worst case scenario.

A redundant HVDC breaker section 305 could also be provided, if desired, in an HVDC breaker 300 wherein no section status indicating device 440 is provided. In such an implementation, all HVDC breaker sections 305, including the redundant HVDC breaker section, could be immediately tripped in response to a worst case line fault scenario, thus yielding a breaking speed—when all HVDC breaker sections 305 operate correctly—that exceeds the requirements for breaking a short circuited HVDC line 210.

Figure 5:
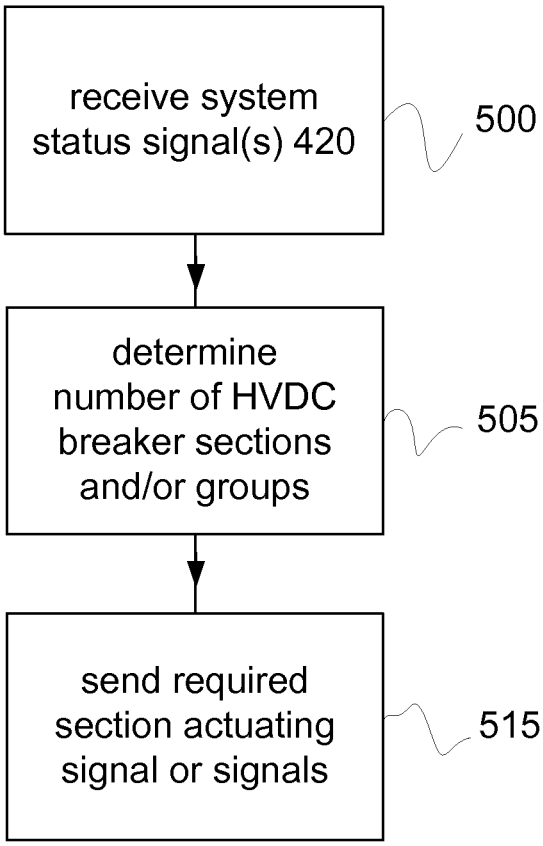
FIG. 5 is an example of a method to be performed by a control apparatus for controlling a sectionalized HVDC breaker.

A flowchart schematically illustrating the operation of an example of an actuating control mechanism 405 is shown in FIG. 5, the actuating control mechanism 405 forming part of a control apparatus 400 for controlling the tripping action of an HVDC breaker 300 comprising a set of HVDC breaker sections 305.

At step 500 of FIG. 5, the actuating control mechanism 405 receives one or more system status signals 420. In step 505, the actuating control mechanism 405 determines how many HVDC breaker sections 305 or groups of HVDC breaker sections of the HVDC breaker 300 should be tripped. The determination is based on the present operational event which is determined depending on the type of the system status signal or signals 420 received. The type of a system status signal 420 can in an implementation be derived from information included in the received system status signal 420 itself and/or from at which input of status signal interface 410 the system status signal was received, since system status signals generated by different sources could be received at different inputs. Further information, such as for example information contained in previously received system status signals 420, could also be used as a basis for the decision, if desired. At step 515, a section actuating signal 435 is then sent to the required number of HVDC breaker sections and/or groups of HVDC breaker sections 305.

In one embodiment, step 505 could include a decision, not only relating to how many HVDC breaker sections 305 and/or groups thereof should be tripped in response to one or more system status signals 420, but could also include a step of selecting which HVDC breaker sections 305 and/or groups thereof should be tripped in the event of part-tripping of the HVDC breaker 300, i.e. in the event when less than all HVDC breaker sections 305 are to be opened in order to break the current. Also in the event of part-tripping, the remaining and thereby closed HVDC breaker sections 305 could eventually be opened once the current has been interrupted, as will be discussed below. Selecting which HVDC breaker sections 305 and/or groups thereof should be opened could for example be performed based on a value obtained from a random number generator, or based on information on which HVDC breaker sections 305 and/or groups thereof were used last time the HVDC breaker 300 was partly tripped, or on information relating to how many times each HVDC breaker section 305 has been tripped, or on the type of the received system status signal 420, or in any other suitable way. By varying which HVDC breaker sections 305 and/or groups thereof are tripped upon part-tripping of an HVDC breaker 300, and/or varying which HVDC breaker section 305 is the redundant breaker section 305—if any—, the usage of the different HVDC breaker sections 305 can be approximately the same. Thus, the different HVDC breaker sections 305 will be aged at approximately the same rate. Furthermore, the chances of detecting a faulty HVDC breaker section 300 will increase. In one embodiment, a step of selecting which HVDC breaker sections and/or groups thereof to trip is instead performed in the HVDC breaker 300, the selection being based on similar principles. Alternatively, no selection step is performed, so that the same HVDC breaker sections 305 will be tripped in response to the same type of system status signals 420.

In one embodiment, the HVDC breaker sections 305 and/or groups thereof that are tripped upon a particular operational event are tripped at the same time, and any further HVDC breaker sections 305 will remain closed. In another embodiment, if opening of less than all HVDC breaker sections 305 is required for breaking the arc current, some or all of the remaining and thereby closed HVDC breaker sections 305 could also be opened once the current has been interrupted, in order to reduce the maximum voltage that each non-linear resistor 130 would risk to experience. For example, once the current has been interrupted by immediate tripping of the required HVDC breaker sections 305, the remaining closed HVDC breaker sections 305 could be tripped in a sequence, one after the other, with a particular time interval; for example in the range of 10-100 ms. The timing of the tripping of the different HVDC breaker sections 305 could for example be controlled by the actuating control mechanism 405 sending the section actuating signals 435 in a sequential manner. Alternatively, once the arc current has been interrupted, the remaining closed HVDC breaker sections 305 could be opened all at the same time. The time interval between the tripping of different HVDC breaker sections 305 could depend on the operational event in response to which the tripping occurs, or could be independent on operational event.

Figure 6:
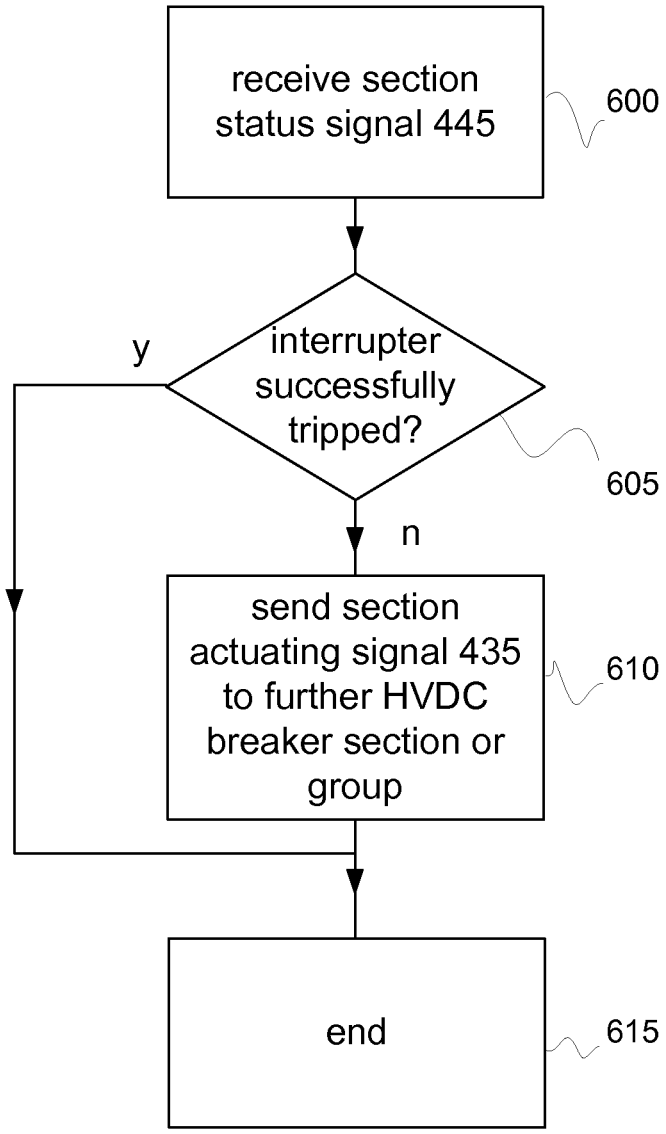
FIG. 6 is an example of a method to be performed by a control apparatus in a system wherein the control apparatus is arranged to receive a section status signal indicative of unsuccessful operation of an interrupter.

As mentioned in relation to FIG. 4, an HVDC breaker section 305 could optionally include a section status indicating device 440. A flowchart of an example of a method performed by the control apparatus 400—for example by the actuating control mechanism 405—upon receipt of a section status signal 445 is schematically illustrated in FIG. 6. At step 600, a section status signal 445 is received from a section status indicating device 440. At step 605, the section status signal 445 is analysed in order to determine whether or not the interrupter 105 to which the section status signal 445 relates has tripped correctly. This analysis could for example include checking whether the arc current has reached a particular value in case the section status indicating device 440 includes a current measuring device, and/or whether the interrupter contacts 135*a,b* have separated correctly if the section status indicating device includes auxiliary contacts. If the interrupter 105 has been successfully tripped, step 615 is entered wherein the method ends. However, if the section status signal 445 indicates that the interrupter 105 has not tripped correctly, then step 610 is entered, wherein a section actuating signal 435 is sent to a further HVDC breaker section 305 (cf. step 515 of FIG. 5) which is currently closed.

In one implementation, a section status indicating device 440 of an HVDC breaker section 305 will only send a section status signal 445 if the tripping of the HVDC breaker section 305 was unsuccessful. Hence, in this implementation, step 605 could be omitted, and step 610 would unconditionally be entered upon receipt of a section status signal 445.

Figure 7:
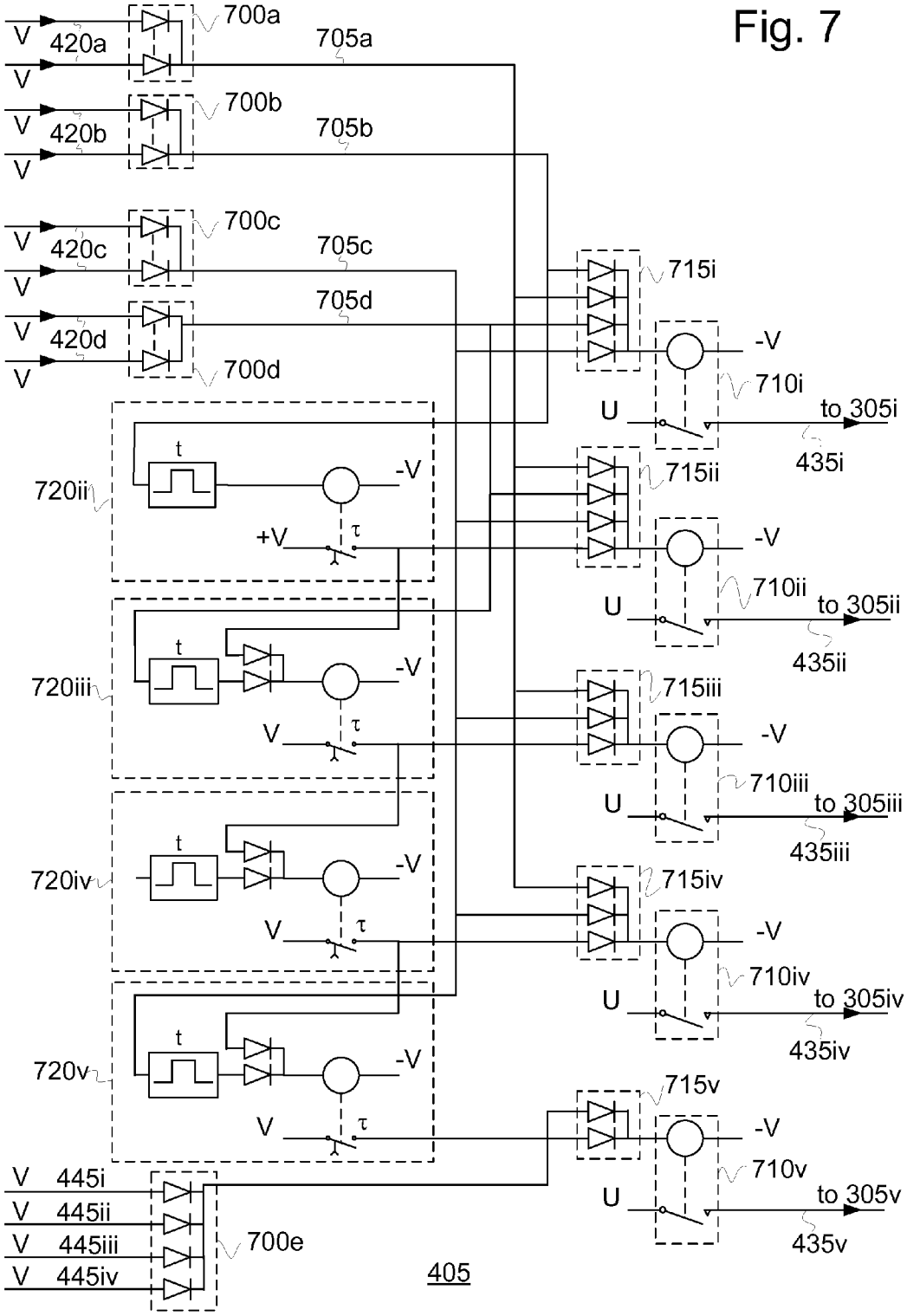
FIG. 7 is an example of a hardware implemented actuating control mechanism for controlling a sectionalized HVDC breaker.

The actuating control mechanism 435 could be implemented by means of hardware, or a suitable combination of hardware and software. FIG. 7 is an illustration of an example of a hardware implementation of the actuating control mechanism 405. The actuating control mechanism 405 of FIG. 7 is arranged to control an HVDC breaker 300 having five HVDC breaker sections 305, of which one HVDC breaker section 305 is redundant. Although they are not shown in FIG. 7, the five HVDC breaker sections 305 of the HVDC breaker section 300 to be controlled by actuating control mechanism 405 of FIG. 7 will hereinafter be referred to as HVDC breaker sections 305*i*, 305*ii*, 305*iii*, 305*iv* and 305*v*, where HVDC breaker section 305*v* is assigned to be the redundant HVDC breaker section.

The actuating control mechanism 405 of FIG. 7 is arranged to receive, via a system status signal interface 410, system status signals 420 of the following system status signal types: System status signals of type 420*a*, the receipt of which will cause the actuating control mechanism 405 to send section actuating signals 435 to immediately trip four HVDC breaker sections 305*i-iv*; system status signals of type 420*b*, the receipt of which will cause the actuating control mechanism 405 to send section actuating signals 435 to trip one HVDC breaker section 305*i* immediately and to trip the remaining HVDC breaker sections 305*ii-v* in a delayed sequential manner of delay τ; system status signals of type 420*c*, the receipt of which will cause the actuating control mechanism 405 to send section actuating signals 435 to trip four HVDC breaker section 305*i-iv* immediately and to trip the remaining HVDC breaker section 305*v* after a delay τ; and system status signals of type 420*d*, the receipt of which will cause the actuating control mechanism 405 to send section actuating signals 435 to trip two HVDC breaker sections 305*i-ii* immediately, and to trip the remaining HVDC breaker sections 305*iii-v* in a delayed sequential manner of delay τ. In FIG. 7, it is shown that the actuating control mechanism 405 is arranged to receive system status signals 420 from two different sources of each of the system status signal types 420*a*-420*d* discussed above, however, an actuating control mechanism 405 could be arranged to receive system status signals 420 of a particular control signal type from any number of system status signal sources, such sources being for example different protection devices, O&M systems, user interfaces, etc.

For each of the system status signal types of which the actuating control mechanism 405 is arranged to receive system status signals 420 from more than one source, the actuating control mechanism 405 comprises an input OR-gate. Input OR-gates 700*a-d* of FIG. 7 are arranged to receive all system status signals 420 of the types 420*a-d*, respectively, that are received by the control system 400 of which the actuating control mechanism 405 forms a part, and to produce an output signal 705*a-d*, respectively, upon receipt of at least one system status signal 420 of the respective type 420*a-d*. The output signals 705*a-d* will hereinafter be referred to as tripping signals 705*a-d*.

Although in FIG. 7, the reference numerals 420, 700 & 705 and reference numerals 305, 435, 445, 710, 715 & 720 only occur with an index, where the indices a-e represent a relation to different system status signals 420*a-e* and the indices i-v represent a relation to different HVDC breaker sections 305*i-v*, respectively, in the description of FIG. 7, the indices are often left out when referring to these devices of FIG. 7 in general.

Actuating control mechanism 405 further comprises, for each HVDC breaker section 305 to be controlled by the control apparatus 400 of which the actuating control mechanism 405 forms a part, a relay device 710. In FIG. 7, relay devices 710*i-v* are shown. A relay device 710 is arranged to send a section actuating signal 435 via interface 415 upon receipt of a tripping signal 705.

The output from an input OR-gate 700 can be connected to the input of one or more relay devices 710, so that the receipt of an system status signal 420 will cause a section actuating signal 435 to be sent to one or more HVDC breaker sections 305 of an HVDC breaker 300. The output from an input OR-gate 700 can for example be connected to an input of a relay device 710 either directly or semi-directly—via an output OR-gate 715, as discussed below—, or via one or more time delay mechanisms 720. A time delay mechanism 720 is arranged to delay the transmission of the tripping signal 705 to the relay device 710 by a time period τ. Four time delay mechanisms 720*ii-v* are included in the actuating control mechanism 405 of FIG. 7, the four time delay mechanisms 720*ii-v* being series connected in a cascade to produce a delay of τ, 2τ, 3τ or 4τ, respectively. A relay device 710 could, if desired, be connected to the output of an input OR-gate 700 via a suitable number of time delay mechanism 720 to produce a suitable delay of the section actuating signal 435 transmitted by the relay device 710 in response to a system status signal 420 received by the input OR-gate 700. A delay of the section actuating signal or signals 435 could for example be desired when the initial opening of an HVDC breaker is performed by opening of less than all of the available HVDC breaker sections 305, so that by eventually opening the remaining closed HVDC breaker sections 305, the breaker 300 can provide better long-term isolation of the two parts of the HVDC line 210 from each other. A cascaded, or sequential opening of the remaining HVDC breaker sections 305 could then be beneficial. The time period τ could for example be in the range of 10-100 ms. The time period τ could be the same for all time delay mechanisms 720 of an actuating control mechanism 405, or could vary between different time delay mechanisms 720.

A relay device 710 can be connected to more than one input OR-gates 700, so that the transmission of a section actuating signal 435 by the relay device 710 can be triggered by more than one type of system status signal 420.

Hence, the connection between an input OR-gate 700 and a relay device 710 can for example be a direct connection; a connection via a further OR-gate 715, referred to as an output OR-gate 715, to which other OR-gates 700 serving other system status signal types are also connected; a connection via a delay mechanism 720; or a connection via a delay mechanism 720 and an output OR-gate 715. A direct connection can be used when the triggering of a section actuating signal 435 by a particular relay device 710 should occur immediately and only in response to one type of system status signal 420. No such connection is shown in FIG. 7, but all connections between input OR-gates 700 and relay devices 710 of FIG. 7 are connections via an output OR-gate 715. Five output OR-gates 715*i-v* are shown in FIG. 7, the output of each being connected to a relay device 710*i-v*. Hence, the HVDC breaker section 305*i-v* of HVDC breaker 300 to be controlled by actuating control mechanism 405 of FIG. 7 can each be tripped by more than one type of system status signal 420.

As mentioned above, the HVDC breaker 300 to be controlled by the actuating control mechanism 405 of FIG. 7 comprises a redundant HVDC breaker section 305*v*. The input of the relay device 710*v* of FIG. 7 which is arranged to send an actuating control signal 435*v* to the HVDC breaker section 305*v* is not directly connected to any of the input OR-gates 700*a-d*, but is connected to the input OR-gates 700*a-d* via time delay mechanisms 720. However, the actuating control mechanism 405 of FIG. 7 further comprises an input OR-gate 700*e*, arranged to receive section status signals 445 from the HVDC breaker 300 and hereinafter referred to as section status input OR-gate 700*e*. The output of the section status input OR-gate 700*e* is connected to the input of the relay device 710*v* serving the redundant HVDC breaker section 305*v*, so that a section actuating signal 435*v* is immediately transmitted to the HVDC breaker section 305*v* upon receipt of an section status signal 435. In this way, fast actuation of the redundant HVDC breaker section 305*v* can be achieved, should the actuation of one of the HVDC breaker sections 305*i-iv* have been unsuccessful.

The actuating control mechanism of FIG. 7 is given as an example only, and can be altered in many ways. For example, if immediate actuation of the HVDC breaker sections 305*i-v* is preferred, some or all of the time delay mechanisms 720 can be omitted. On the other hand, if it would be desired that the receipt of all types of system status signals 420 should trigger a time delayed tripping of at least one HVDC breaker section 435, the output of all input OR-gates 700*a-d* could be connected to at least one time delay mechanism 420. The number of relay devices 710 could be altered to correspond to a different number of HVDC breaker sections 305 of the HVDC breaker 300 to be controlled. The number of AND-OR-gates could be altered to correspond to a different number of system status signal types. If the actuating control mechanism 405 is arranged to receive system status signals 420 of a particular system status signal type from only one source, the OR-gate 700 for this particular type could be omitted.

Input AND-OR-gates 700*a-e* and output OR-gates 715*i-v* of FIG. 7 are designed by means of diodes 705 in a conventional manner. A relay device 710 can for example be realised by means of a relay and a relay coil, as indicated in FIG. 7. The time delay mechanisms 720 of FIG. 7 are designed by means of a pulse generator generating a pulse of duration t, a relay coil and a time delay make. Other ways of realising OR-gates 700 and 715; time delay mechanisms 720; and relay devices 710 can also be contemplated.

System status signal interface 410, section actuating signal interface 415 and section status signal interface 450 are not shown in FIG. 7. Such interfaces could for example be conventional signal input/outputs.

Figure 8:
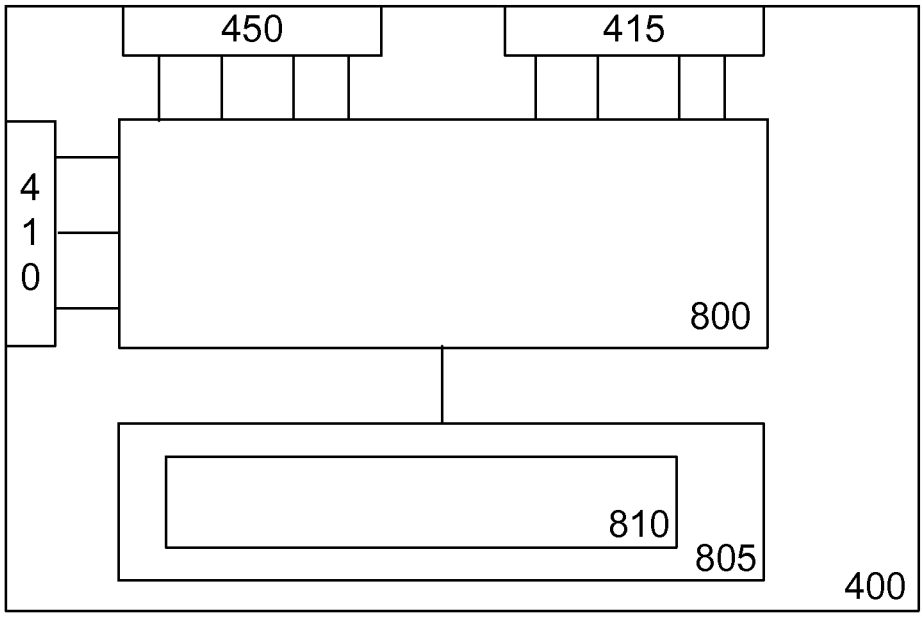
FIG. 8 is a schematic illustration of an example of a software implemented actuating control mechanism for controlling a sectionalized HVDC breaker.

In FIG. 8, an alternative way of schematically illustrating the control apparatus 400 of FIG. 4 is shown, wherein the actuating control mechanism 405 is implemented by using a combination of hardware and software. FIG. 8 shows the control apparatus 400 comprising processing means 800 connected to a computer program product 805 in the form of a memory, as well as to interfaces 410, 415 and 450 (cf. FIG. 4). The memory 805 stores computer readable code means in the form of a computer program 810, which, when executed by the processing means 800, causes the actuating control mechanism 405 to perform a section actuating control method, examples of which are illustrated in FIGS. 5 and 6. In other words, the actuating control mechanism 405 would in this embodiment be implemented by means of one or more general purpose processors or one or more processors especially developed for the control apparatus 400, in combination with software 810 for performing section actuating control. The software 810 could for example include a mapping table, such mapping table mapping for example possible values which may be contained in the system status signals 420, or the possible inputs of system status signal interface 410 at which system status signals 420 may be received, to a first value indicating the number of HVDC breaker sections 305 and/or groups of HVDC breaker sections 305 that should be tripped. In a further embodiment, the mapping could include a second value indicating which of the HVDC breaker sections 305 and/or groups of HVDC breaker sections 305 should be tripped. Alternatively, instead of a first and second value, the mapping table could include just an indication of which HVDC breaker sections 305 and/or groups thereof are to be tripped without explicitly stating their number. In FIG. 8, the software 810 is shown to be stored on one physical memory 805, however, software 810 could be divided onto more than one physical memory 805. A memory 805 could be any type of non-volatile computer readable means, such as a hard drive, a flash memory, an EEPROM (electrically erasable programmable read-only memory) a DVD disc, a CD disc, a USB memory, etc.

Figure 9:
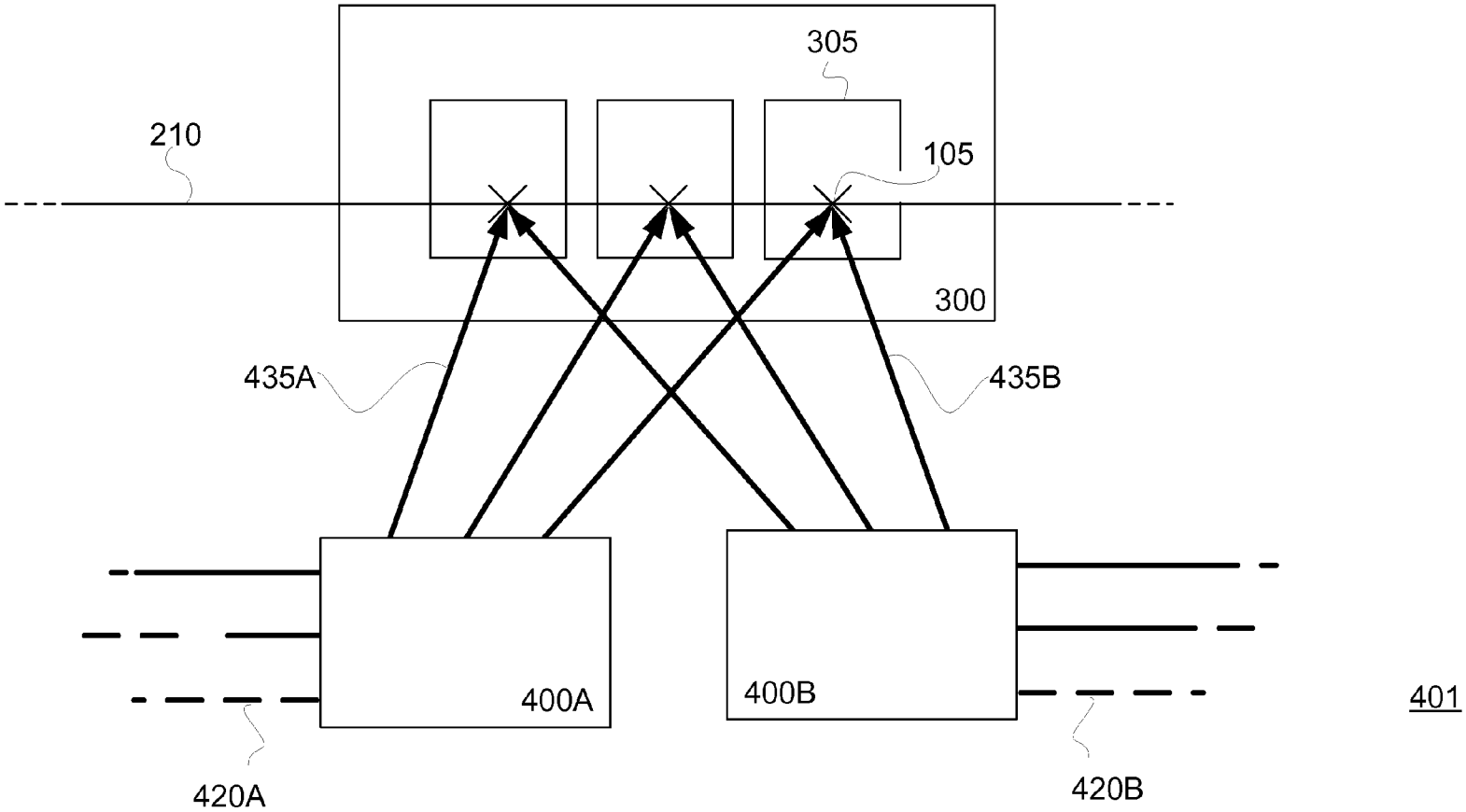
FIG. 9 is a schematic illustration of an HVDC breaker system wherein an HVDC breaker can be independently controlled by two independent control apparatuses.

In order to further improve the reliability of a sectionalised HVDC breaker 300, the sectionalised HVDC breaker 300 may be combined with a redundant control system. In FIG. 9 is shown an HVDC breaker system 401 comprising a sectionalised HVDC breaker 300 which is arranged to receive section actuating signals 435 from two independently operating HVDC control apparatuses 400A and 400B. Control apparatuses 400A and 400B of FIG. 9 are in turn arranged to receive system status signals 420A and system status signals 420B, respectively, which originate from independent sources. In order to yet further improve the reliability of HVDC breaker 300, the HVDC breaker sections 305 could include redundant tripping mechanisms, for example redundant trip coils, which are each connected to both of control apparatus 400A and 400B.

The combination of a sectionalised HVDC breaker 300 and a duplicated control system results in a very high degree of reliability. No single contingency failure will cause unsuccessful operation of the HVDC breaker 300. For example, if a status signal 420A fails, a corresponding status signal 420B will still be received by control apparatus 400B; if the control apparatus 400A fails, control apparatus 400B will still order the required operation of the HVDC breaker 300; if one HVDC breaker section 305 fails, a section status indicating device 440 could initiate the operation of a further HVDC breaker section 305. Furthermore, in most cases when several HVDC breaker sections 305 are ordered to interrupt the DC current, the correctly operating HVDC breaker sections 305 will interrupt the DC current even if one HVDC section 305 fails.

Figure 10:
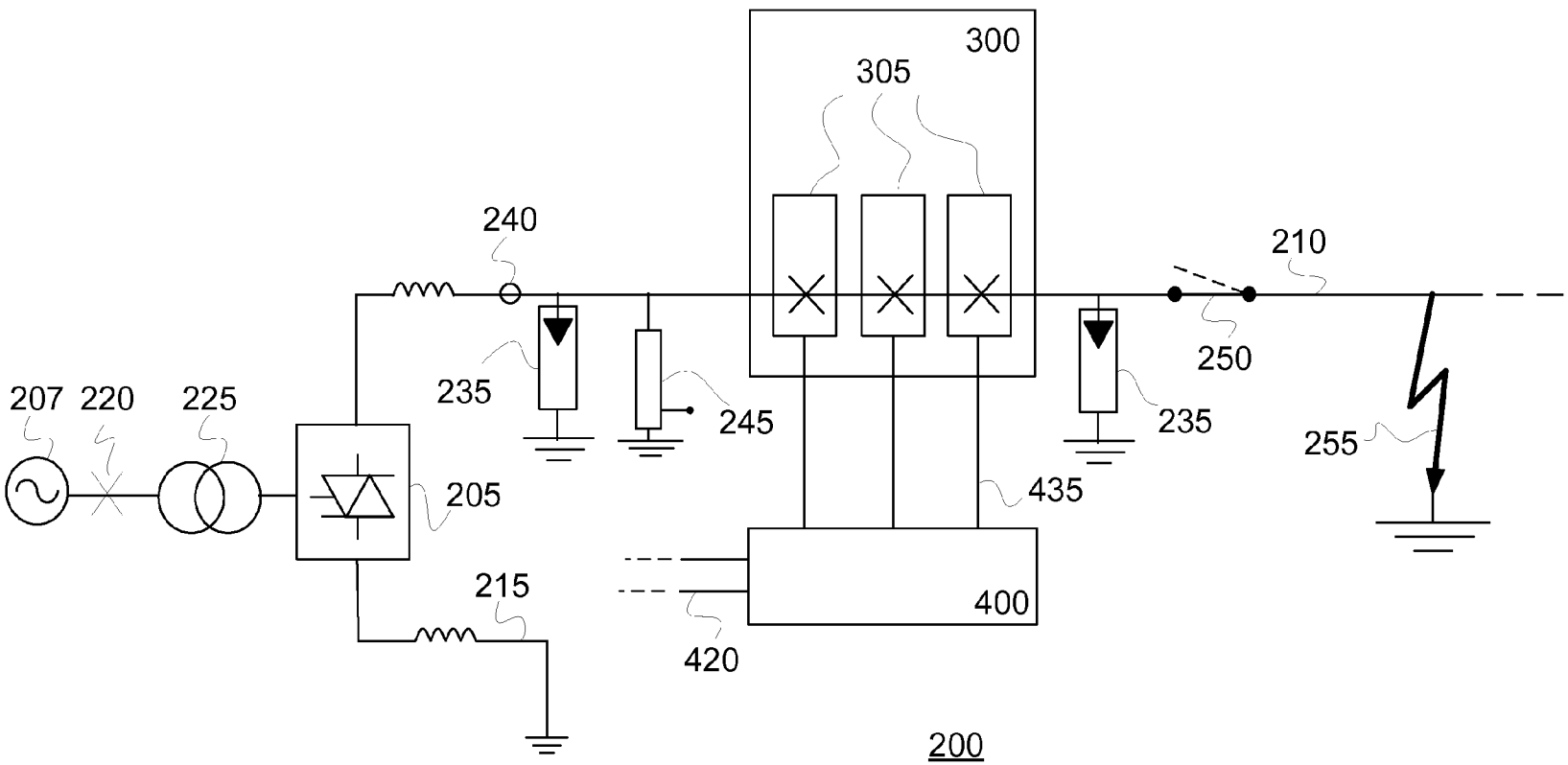
FIG. 10 is a schematic illustration of an example of an HVDC system comprising sectionalized HVDC breakers.

FIG. 10 illustrates a monopolar HVDC system 200 including a sectionalised HVDC breaker 300 having three different HVDC breaker sections 305, the tripping of which is controlled by a control apparatus 400. The control apparatus 400 is arranged to receive at least one system status signal 420, and to determine the number of HVDC breaker sections 305 to be tripped in response to received system status signal or signals 420. The control apparatus 400 is moreover arranged to send, to an HVDC breaker section 305, section actuating signal or signals 435 in response to which the interrupters 105 of the determined number of HVDC breaker sections 305 will be tripped.

Figure 11:
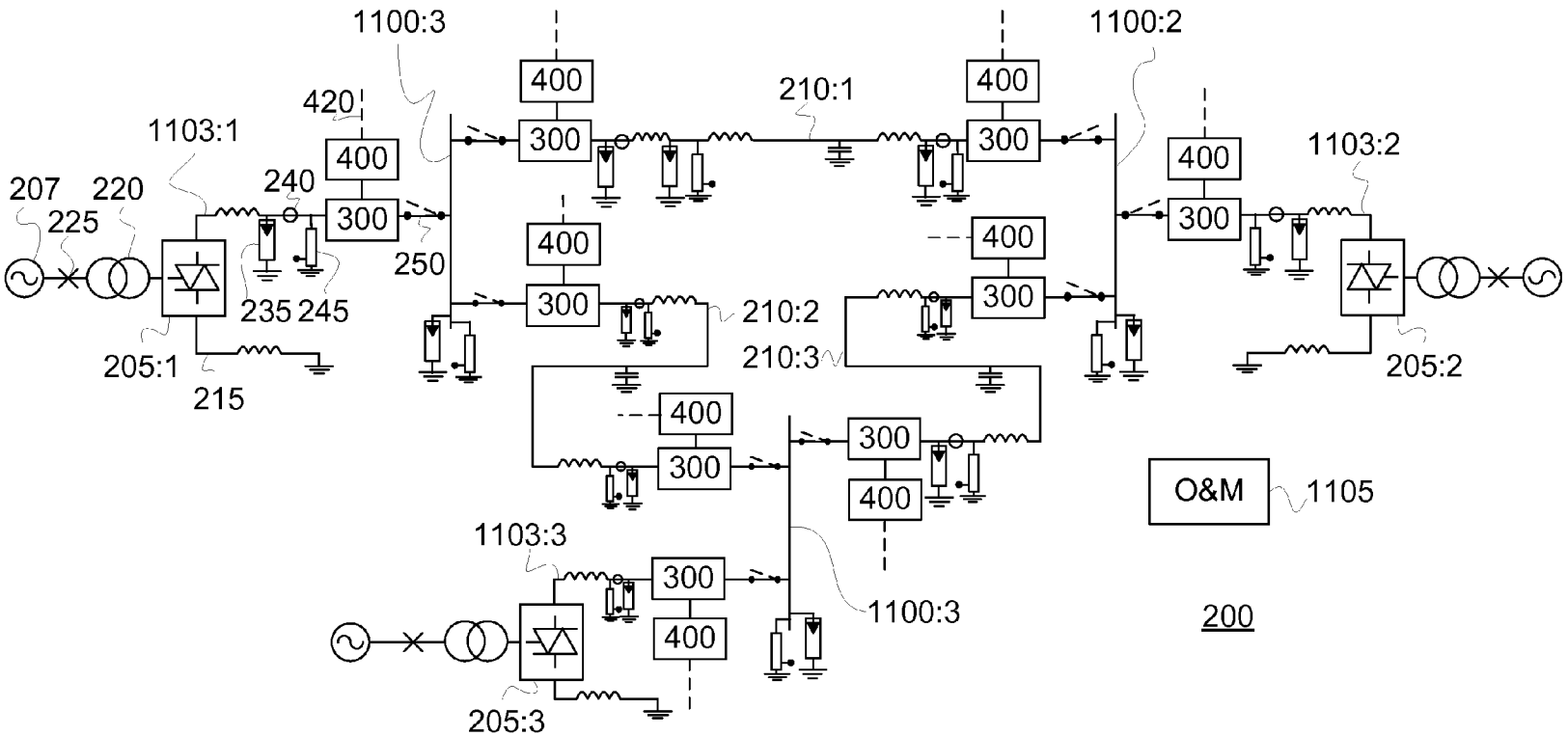
FIG. 11 is a schematic illustration of an example of another HVDC system comprising sectionalized HVDC breakers.

The monopolar HVDC system 200 of FIG. 10 is shown as an example for purposes of illustration. However, the technology discussed herein is applicable to any HVDC system 200—monopolar or bipolar; with voltage source converters 205 or line commutated converters 205; a system comprising a network of several HVDC converter stations 205 or a single line connecting two converter stations 205, etc. In FIG. 11, another HVDC system 200 is shown, wherein three HVDC converter stations 205:1, 205:2 & 205:3 are arranged in a network via HVDC lines 210:1, 210:2 & 210:3 and DC buses 1100:1, 1100:2 & 1100:3. Furthermore, the HVDC converters 205:1, 205:2 & 205:3 are connected to the DC buses 1100:1, 1100:2 & 1100:3 via bus bar arrangements 1103:1, 1103:2 & 1103:3, respectively. For the sake of clarity, reference numerals have, for most component types occurring in FIG. 11, only been indicated once. Where applicable, the same reference numerals as in FIGS. 2 & 9 have been used.

Sectionalized HVDC breakers 300 are located at several locations in system 200 of FIG. 11, so that HVDC lines 210:1, 210:2 and 210:3 may be efficiently disconnected, or an HVDC converter 205:1, 205:2, 205:3 efficiently disconnected, in dependence on a number of operational events that so require. In FIG. 11, sectionalized HVDC breakers 300 are connected at each end of the HVDC lines 210:1, 210:2 and 210:3; as well as between an HVDC converter 205 and the DC bus 1100 connecting the HVDC converter 205 to the network. Each sectionalized HVDC breaker 300 is connected to a control apparatus 400, which in turn is connected to sources of system status signals 420. Sources of system status signals 420 may for example be current measurement devices 240, voltage measurement devices 245 or an O&M system 1105. For purposes of illustration clarity, connections between the control apparatus 400 and the sources of system status signal 240 have only been indicated as a dashed line entering each control apparatus 400. A particular control apparatus 400 is typically connected to sources of system status signals 240 which monitor operational events that require the tripping, including the part-tripping, of the HVDC breaker 300 which is controlled by the control apparatus 400.

By providing the possibility of efficiently breaking an HVDC line 210 in a manner so that the trade-off between a short breaking time and low transients in the system 200 can be customized for different operational events, the use of sectionalized HVDC breakers 300 can considerably reduce the risk of a properly operating HVDC converter 205 or HCDC line 210 having to be taken out of operation when another part of the system 200 is exhibiting a fault or is due for service or maintenance. For example, if HVDC line 210:1 of FIG. 11 were to exhibit a line fault, the HVDC converters 205:1, 205:2 and 205:3 could continue to supply power to the network via HVDC lines 210:2 and 210:3, even if HVDC line 210:1 had to be taken out of operation.

An HVDC breaker section 305 could for example be designed in accordance with the HVDC breaker 100 of FIG. 1, or in accordance with any other suitable HVDC breaker design. For example, an HVDC breaker section 305 could include a pre-insertion resistor in order to limit the in-rush current upon re-closing of the HVDC breaker 300; and/or an electronic support circuit for assisting in generating current oscillations in order to force a current zero upon opening of the interrupter 105, etc. Examples of electronic support circuits are disclosed in EP 0 660 352.

In the appended drawings, the HVDC breakers 300 have been illustrated such that the section actuating signals 435 are received directly by the interrupter 105 of an HVDC breaker section 305. However, the invention is equally applicable to HVDC breaker designs where section actuating signals 435 are initially received by another part of the HVDC breaker 300, such as for example a processor controlling the operation of an interrupter 105.

The size of a capacitance 130 of an HVDC breaker section 305 is typically selected so that the maximum current expected to occur in the breaker 300, for example in the order of ten times the rated line current, can efficiently be commutated to the capacitance 130. The inductance 125 of the resonant circuit 115 could often be formed by the stray inductance of the circuit 115, so that no separate inductance 125 is required, or, alternatively, an inductor may be introduced in resonant circuit 115.

The different HVDC breaker sections 305 of an HVDC breaker 300 could be identical, or could be designed to have different properties. For example, a non-linear resistor 120 of a first HVDC breaker section 305 could have a different value than the non-linear resistor 120 of another HVDC breaker section 305. This would result in different requirements also on the capacitances 130. Furthermore, some but not all of the HVDC breaker sections 305 could include a pre-insertion resistor; some but not all could include an electronic support circuit, some but not all could include a section status indicating device 440, etc.

The value of the total SIPL-value of an HVDC breaker 300, i.e. the sum of the SIPL value of the non-linear resistors 120 of the different HVDC breaker sections 305, not including the SIPL value of any redundant HVDC breaker sections 305, should preferably exceed the rated line voltage of the HVDC line 210. The value of the ratio between the total SIPL value and the rated line voltage could preferably be set so that the non-linear resistors 120 would not be harmed even if the open HVDC breaker 300 is exposed to the full line voltage during a longer period of time, and so that the energized HVDC converter 205 from the HVDC line 210 is efficiently isolated from the HVDC line 210 in case of earth faults. A suitable value of the total SIPL depends inter alia on properties of the material from which the non-linear resistors 120 are formed. When the non-linear resistors 120 are formed from zinc oxide, this value could for example be 1.5-1.8 times the rated line voltage. If one or more redundant HVDC breaker sections 305 are included in the HVDC breaker 300, the sum of all the SIPL-values of the non-linear resistors of the HVDC breaker 300, including the redundant section or sections, typically exceeds the desired total SIPL-value at least by the SIPL value of the redundant HVDC breaker sections 305.

As mentioned above, the non-linear resistors 120 could for example be zinc oxide resistors arranged in a configuration which provides a desired SIPL. A non-linear resistor 120 could alternatively be formed from other materials, such as for example silicon carbide.

Although various aspects of the invention are set out in the accompanying independent claims, other aspects of the invention include the combination of any features presented in the above description and/or in the accompanying claims, and not solely the combinations explicitly set out in the accompanying claims.

One skilled in the art will appreciate that the technology presented herein is not limited to the embodiments disclosed in the accompanying drawings and the foregoing detailed description, which are presented for purposes of illustration only, but it can be implemented in a number of different ways, and it is defined by the following claims.

The invention claimed is:

1. An HVDC breaker comprising a first parallel connection of a corresponding non-linear resistor and at least one corresponding interrupter, where the resistance of the corresponding non-linear resistor of the first parallel connection decreases with increasing voltage, wherein the HVDC breaker is sectionalized in that the HVDC breaker further comprises at least one further parallel connection of a corresponding non-linear and at least one corresponding interrupter, the first and further parallel connections being connected in series;

at least one of said parallel connections and/or at least one group of said parallel connections is arranged to be controlled individually from the other said parallel connections; and the HVDC breaker is arranged in a manner so that the number of said parallel connections to be tripped upon tripping of the HVDC breaker depends on the operational event in response to occurrence of the tripping.

2. The HVDC breaker of claim 1, further arranged so that different types of operational events, in response to the occurrence of the tripping and in dependence on which the number of said parallel connections and/or groups of said parallel connections to be tripped will be adjusted, include:

a line fault situation, and the breaking of an HVDC line during normal operation.

3. The HVDC breaker of claim 1, wherein said parallel connection comprises at least one mechanically operated interrupter and/or at least one power semiconductor interrupter.

4. The HVDC breaker of claim 1, wherein at least one of said parallel connections comprises a section status indicating device arranged to detect if the operation of a parallel connection has been unsuccessful, and to generate a section status signal indicative of unsuccessful operation in case a parallel connection has not operated successfully.

5. The HVDC breaker of claim 1, wherein the HVDC breaker comprises at least one redundant parallel connection of a corresponding non-linear resistor and at least one corresponding interrupter.

6. An HVDC breaker system comprising the HVDC breaker of claim 1, the HVDC breaker system further comprising a control apparatus for controlling the tripping of an HVDC breaker, the control apparatus comprising:

a system status signal interface arranged to receive system status signals of at least two different types, wherein the system status signal type is indicative of an operational event in an HVDC system of which the HVDC breaker forms a part;

a section actuating signal interface arranged to transmit, to the HVDC breaker, at least one section actuating signal causing at least one individually controllable parallel connection and/or group of parallel connections of the HVDC breaker to trip; and an actuating control mechanism to the system status signal interface and to the section actuating signal interface, wherein the actuating control mechanism is arranged to determine, based on information relating to the type of at least one received system status signal, the number of said parallel connections and/or groups of said parallel connections that should be tripped, and to send, via the section actuating signal interface, a corresponding section actuating signal or signals to trip said number of parallel connections and/or groups of parallel connections.

7. The HVDC breaker system of claim 6, wherein different types of operational events of which a system status signal may be indicative include:

a line fault situation, and the breaking of an HVDC line during normal operation.

8. The HVDC breaker system of claim 6, wherein the actuating control mechanism is further arranged to select which of said parallel connections and/or groups of said parallel connections are to be tripped in response to the receipt of the system status signal and to send, via the section actuating signal interface, the corresponding section actuating signal or signals to trip the selected parallel connection(s) and/or group(s) of parallel connection(s).

9. The HVDC breaker system of claim 6, further comprising an interface arranged to receive, from a section status indicating device, a section status indicative of unsuccessful operation of a parallel connection; and wherein the actuating control mechanism is arranged to send, in response to receipt of a section status signal indicative of unsuccessful operation of a parallel connection, a section actuating signal to trip the at least one corresponding interrupter of a parallel connection or group of parallel connections wherein the corresponding interrupter(s) are currently closed.

10. The HVDC breaker system of claim 6, wherein the actuating control mechanism is arranged to send, in response to receipt of at least one type of system status signal, a corresponding section actuating signal or signals to trip the corresponding interrupters of at least one of said parallel connections and/or group of said parallel connections at a first point in time and the corresponding interrupters of at least a further of said parallel connections and/or group of said parallel connections at another point in time.

11. The HVDC breaker system according to claim 6, further comprising a further control apparatus, wherein the HVDC breaker is arranged to be controlled by the first control apparatus and by the further control apparatus independently from each other; and wherein the further control apparatus is arranged to receive at least one section status signal from at least one different section status signal source than the first control apparatus.

12. An HVDC power transmission system comprising the HVDC breaker system of claim 6.

13. A method of interrupting a DC current in an HVDC system, the method comprising:

receiving, in a control apparatus for controlling an HVDC breaker, a system status signal the type of which is indicative of an operational event requiring the interruption of the DC current, wherein the control apparatus is arranged to control an HVDC breaker being sectionalized in that the HVDC breaker comprises at least two series-connected parallel connections of a corresponding non-linear resistor and at least one corresponding interrupter, where the resistance of the corresponding non-linear resistor decreases with increasing voltage; and where at least one of said parallel connections and/or at least one group of said parallel connections is arranged to be controlled individually from the other said parallel connections; the method further comprising:

determining, in dependence on the type of the system status signal received, the number of said parallel connections and/or groups of said parallel connections to be used for interrupting the DC current; and sending, to the HVDC breaker, a corresponding section actuating signal or signals to trip said number of said parallel connections and/or groups of parallel connections.

14. The method of claim 13, wherein possible operational events of which the system signal type may be indicative include:

a line fault situation, and the breaking of an HVDC line during normal operation.

15. The method of claim 13, wherein the determining is performed by means of a mapping table, where the mapping table maps, for at least two system status signal types, the type of system status signal to the number of parallel connections and/or groups of parallel connections to be tripped upon receipt of that system status signal type.

16. The method of claim 13, wherein the step of determining further comprises selecting which of said parallel connections and/or groups of said parallel connections are to be tripped in response to the receipt of the system status signal; and the corresponding section actuating signal or signals are sent to trip the corresponding interrupters of the selected parallel connection(s) and/or group(s) of parallel connections.

17. The method of claim 13, further comprising receiving, from a section status indicating device, a section status signal indicative of the unsuccessful operation of a parallel connection; and sending, in response to receipt of said section status signal, a section actuating signal to trip the corresponding interrupter(s) of a parallel connection or group of parallel connections wherein the corresponding interrupter(s) are currently closed.

18. The HVDC breaker of claim 2, wherein said parallel connection comprises at least one mechanically operated interrupter and/or at least one power semiconductor interrupter.

19. The HVDC breaker of claim 2, wherein at least one of said parallel connections comprises a section status indicating device arranged to detect if the operation of a parallel connection has been unsuccessful, and to generate a section status signal indicative of unsuccessful operation in case a parallel connection has not operated successfully.

20. The HVDC breaker of claim 3, wherein at least one of said parallel connections comprises a section status indicating device arranged to detect if the operation of a parallel connection has been unsuccessful, and to generate a section status signal indicative of unsuccessful operation in case a parallel connection has not operated successfully.

* * * * *